United States Patent [19]

Freisler

[11] 3,987,822

[45] Oct. 26, 1976

[54] BAND WHEEL ON A SHUTTLELESS LOOM

[75] Inventor: Erhard Freisler, Bubikon, Switzerland

[73] Assignee: Ruti Machinery Works Ltd., Ruti, Zurich, Switzerland

[22] Filed: Mar. 10, 1975

[21] Appl. No.: 557,087

[30] Foreign Application Priority Data

Mar. 11, 1974 Switzerland ..... 3341/74

[52] U.S. Cl. ..... 139/449; 29/121.6; 74/230.01

[51] Int. Cl.[2] ..... D03D 47/12

[58] Field of Search ..... 139/123, 122 R, 127 R; 74/230.01, 230.05, 230.4, 230.5, 230.6, 230.7, 89.22, 572; 29/110, 113, 123

[56] References Cited

UNITED STATES PATENTS

| | | | |
|---|---|---|---|
| 361,914 | 4/1887 | Wing | 74/230.05 X |
| 2,315,301 | 3/1943 | Van Deventer et al. | 74/230.01 |
| 2,925,739 | 2/1960 | Urquhart et al. | 74/230.01 |
| 3,188,775 | 6/1965 | Cosmos | 74/230.7 |
| 3,304,924 | 2/1967 | Dolza | 74/230.4 X |
| 3,318,165 | 5/1967 | McAleer et al. | 74/230.4 X |
| 3,323,555 | 6/1967 | Flamand | 139/122 R |
| 3,361,004 | 1/1968 | Williams et al. | 74/230.05 X |

FOREIGN PATENTS OR APPLICATIONS

| | | | |
|---|---|---|---|
| 916,735 | 1/1963 | United Kingdom | 74/230.01 |

*Primary Examiner*—James Kee Chi
*Attorney, Agent, or Firm*—Donald D. Denton

[57] ABSTRACT

A band wheel for insertion of a filling thread by alternate rotation of the band wheel formed from a hub, a wheel body connected to the hub, and having flat elements which extend for stiffening both transverse to the axis of rotation and parallel to it.

14 Claims, 6 Drawing Figures

BAND WHEEL ON A SHUTTLELESS LOOM

BACKGROUND OF THE INVENTION

The present invention relates to a band wheel on a shuttleless loom for operation of a flexible band for the insertion of the filling by an oscillating movement upon the alternate rotation of the band wheel.

In a shuttleless loom, the filling thread is inserted from one side of the loom up to approximately the center of the shed by means of a gripper which is arranged at the end of the flexible band and the thread is turned over there to a second gripper arranged at the end of another flexible band on the other side of the loom whereby it is pulled over the entire width of the shed. Thus, a band wheel having a flexible band fastened at one end to its periphery is arranged on each side of the loom, whereupon rotation of each of the band wheels with continuously alternating direction of rotation, the flexible band is unwound from the periphery and wound onto it.

Upon each change in the direction of rotation of the band wheel, it must be stopped and then again accelerated so that the length of the flexible band, which depends on the width of the loom, is wound and unwound on and from the periphery of the band wheel. In normal shuttleless loom operations, a wheel diameter of 60 to 70 cm must be designed since a band wheel, which is relatively heavy because of its size, also has a large moment of inertia. In the known band wheels of looms of this type, which are developed as cast spoked wheels, this is a disadvantage and furthermore the manufacture of these known band wheels itself also requires numerous operations which detrimentally increase the cost of the band wheels.

SUMMARY OF THE INVENTION

This invention contemplates a band wheel which is light as possible with a correspondingly small moment of inertia, which therefore is also particularly economical in manufacture. In order to achieve this, the band wheel of the invention is characterized by the fact that it consists of a hub and a wheel body connected therewith which has flat elements extending for stiffening, both transverse and parallel to the axis of rotation. In this connection, the band wheel may suitably consist of lightweight metal or plastic. Flat elements of this material can be connected together economically by pressing and/or cementing.

In one suitable embodiment, the band wheel has two circular disks arranged in parallel on a hub, which serve as flat elements extending transverse to the axis of rotation, and spacer elements inserted between the disks serving as flat elements extending parallel to the axis of rotation. Furthermore, the band wheel may also consist of one disk arranged centrally on the hub, and on both sides thereof radially extending stiffening ribs adjoining the disk. Similarly, it may also consist of a disk arranged on one end of a hub and of stiffening ribs adjoining the disk on one side. In order to make the band wheel even lighter, each disk can be provided with openings, preferably circular bore holes, distributed over its surface. The material removed by these openings would account for up to about two-thirds of the surface of the disk. Instead of the stiffening ribs, the space between two disks can also be filled with hard plastic foam.

Another suitable embodiment consists of a single piece, injection molded or compressed molded, which is of honeycomb shape and has in each case honeycombs open alongside of each other towards one and the other side of the wheel which are distributed uniformly over both sides of the wheel.

In so far as the band wheel constructed of flat elements is not additionally filled up to the circumference of the wheel with hard plastic foam, it may possess on the circumference thereof a linear supporting surface for the band, which is advisedly wider than the width of the band wheel, so that it rests on the circumference of the disks or the stiffening ribs. In this way upon movement of the wheel a certain circulation of air can occur on both sides of the band which produces a cooling effect and facilitates keeping the band wheel free of fibers and dust. Furthermore, each time that the flexible band is unwound from the band wheel upon insertion into the shed, it lifts itself from the circumference of the wheel somewhat, as a result of which the aforementioned effect is further supported and there is made possible a better removal of the frictional heat which is produced upon the sliding of the band along so-called band shoes which must be arranged on the other outer side of the flexible band along the circumference of the wheel in order to support the band. This is because, during the insertion of the filling thread into the shed, the band is pushed from its rear end, which is fastened to the wheel, and must be held to the circumference of the wheel as much as possible.

In addition to the aforementioned advantages, the light weight is also particularly advantageous in view of the small moment of inertia produced, as is also the simplicity of manufacture of the new band wheel by injection molding or cementing or pressing flat elements together.

BRIEF DESCRIPTION OF THE DRAWINGS

Various embodiments of band wheel covered by this invention will be described in further detail below with reference to the accompanying drawings, in which:

FIG. 7 is a front view and FIG. 8 is a paraxial cross-sectional view taken on the line A—A of FIG. 7 of still a further embodiment of the band wheel which forms a honeycomb single-piece injection molded or compressed molded band wheel provided with compartments which are open alternately towards one side and the other.

DESCRIPTION OF PREFERRED EMBODIMENTS

Figure 1:
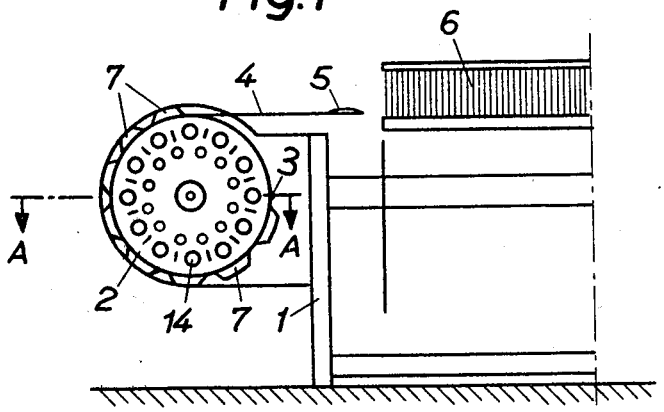
FIG. 1 shows schematically a front view of one half of a loom with the band wheel arranged on the side thereof, defining a plurality of holes therein to produce a lightweight construction.

The left-hand side of the loom 1 shown schematically in FIG. 1 has attached to its side a band wheel 2 which is rotated alternately to the right and left by a drive (not shown). The flexible band 4 is fastened by its one end 3 to the circumference of the band wheel and is unwound from the band wheel and then again wound onto it so that the gripper 5 arranged on the free end of the flexible band enters into the shed 6 with the filling thread and is then drawn out of it again. On insertion of the filling thread, the band wheel is rotated in clockwise direction and the flexible band is pushed forward from the attached end 3 on the band wheel. The band must be held as closely as possible to the periphery of the wheel, for which purpose so-called band shoes 7, under which the band slides, are arranged along the periphery of the wheel from the point of attachment 3 of the band up to the point lying vertically above the axis of the wheel from where the flexible band 4 is conducted tangentially sidewards into the shed. It will be appreciated that frictional heat is produced during the band's movement into the shed which must be removed to the greatest extent possible. In this connection, it should be mentioned that the band wheel is surrounded by a housing (not shown in the drawing) in order to protect it from dust and fibers as well as to prevent accidents. When the band is drawn out of the shed upon the opposite direction of rotation of the wheel, i.e. counterclockwise, the flexible band is wound on the band wheel, in which connection no friction takes place.

Figure 2:
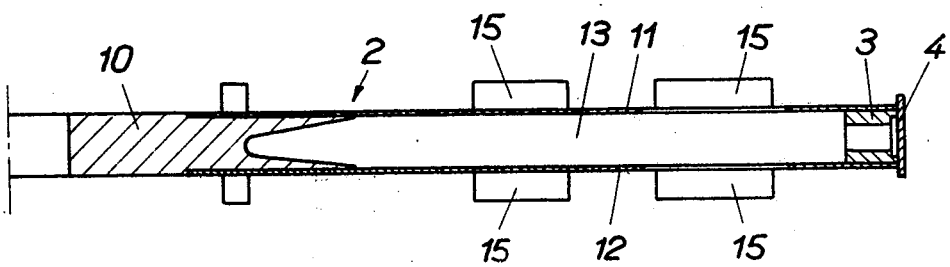
FIG. 2 is a paraxial cross-sectional view of half the band wheel of FIG. 1 along the line A—A, shown on a larger scale.

In order that the band wheel 2 is as light as possible in order to have a small moment of inertia, it consists of two circular disks 11 and 12 (see FIG. 2) arranged in parallel on a hub 10 and between which radial stiffening ribs 13 are arranged serving as spacer elements. The band wheel thus consists of flat parts which are stamped and assembled by pressing and/or bonding, or the like. In order for the band wheel to be light, the parts consist of plastic or light metal, in which connection in particular a band wheel which consists of plastic is low in noise. In addition, each disk has openings distributed over its surface, preferably circular holes 14, as can be noted from FIG. 1, as a result of which the weight of the disk can be further reduced by up to two-thirds. With all the above mentioned features, the band wheel is particularly cheap to manufacture and has low weight so as to produce only a small moment of inertia.

The frictional heat produced by the sliding of the band along the said band shoes is discharged better than in the case of traditional band wheels since the band rests only on the periphery of two disks between which air can circulate. A part 3, as can be noted from FIG. 2, intended for the fastening of the band is merely placed between the disks at the fastened end of the flexible band. It will be appreciated that narrow vanes 15 can be arranged on the outside on the two disks 11 and 12 and serve, upon the rotation of the wheel in the housing, to further improve the circulation of the air.

Figure 4:
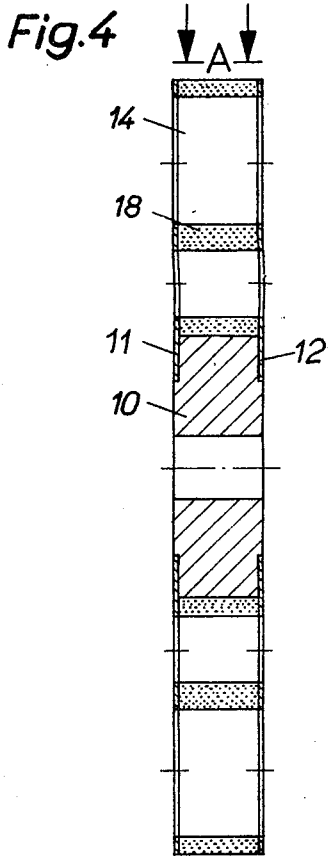
FIG. 4 is a cross-sectional view taken on the line A—A of FIG. 3 of a different embodiment of the band wheel with hard plastic foam filling between two disks and defining holes for reduction in weight of the band wheel.
Figure 3:
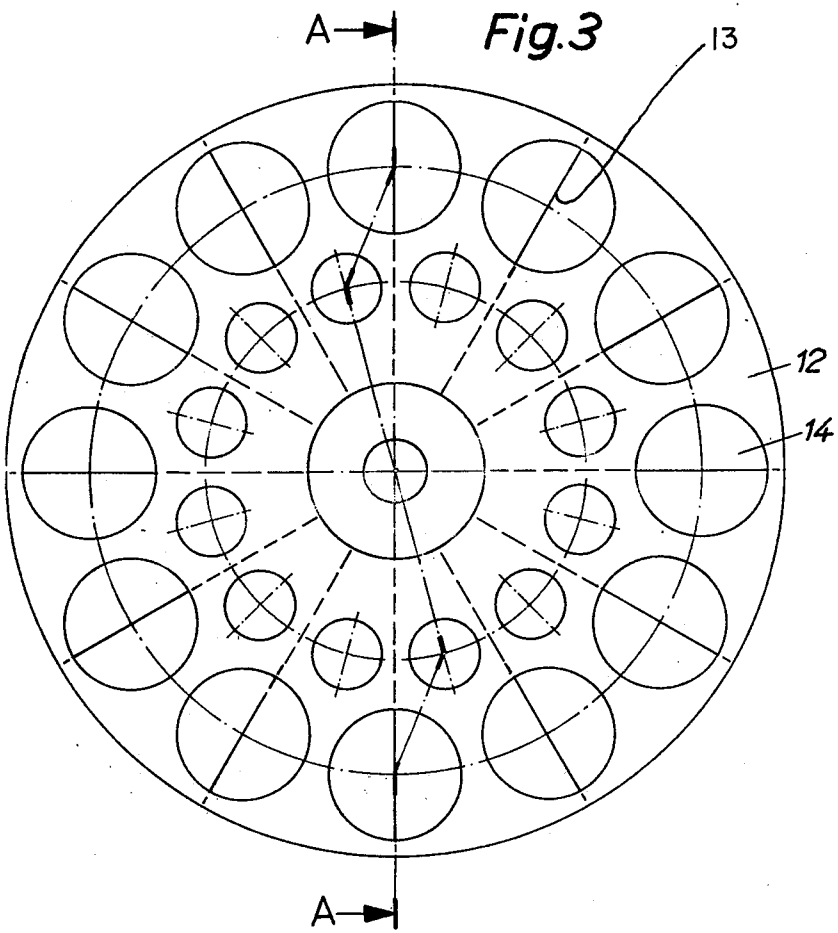
FIG. 3 is a front view of a band wheel with two spaced disks that define holes so that the weight of the wheel body is reduced.

In the case of the band wheel shown in the front view and the axial section in FIGS. 3 and 4, respectively, the disks 11 and 12 which are fastened to a hub member 10 are provided with holes 14 arranged in a circle which is concentric with the axis of rotation of the wheel, and the holes have larger diameter at the outer edge than the holes lying on the inner circle near the hub, whereby the total distributed weight of the band wheel is considerably reduced. The space between the two disks is filled with plastic hard foam 18 through which the bore holes 14 also extend. In this way a band wheel of good dimensional stability and relatively light weight is produced.

Figure 5:
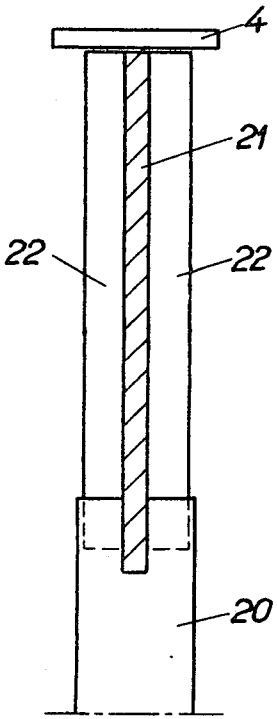
FIG. 5 is a paraxial cross-sectional view of half of a band wheel showing another embodiment with one disk attached to a hub and stiffening ribs arranged on both sides of the disk.

The half band wheel shown in the paraxial cross-sectional view in FIG. 5 has only one disk 21 arranged concentrically on a hub member 20 and adjoining which on both sides there are radial stiffening ribs 22 which are anchored in the hub member and extend radially outward and to the outer periphery of the disk 21 so that the band 4 rests on the disk as well as on the ribs.

Figure 6:
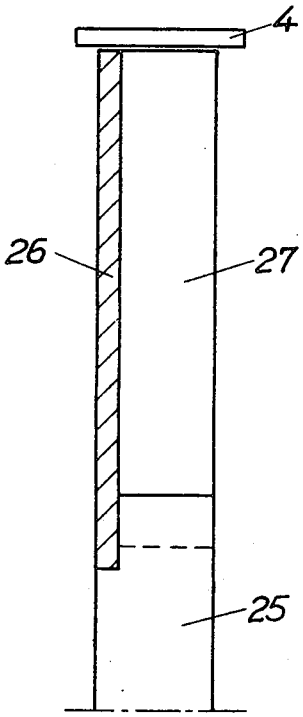
FIG. 6 is a paraxial cross-sectional view of half of a band wheel in still a further embodiment with one disk arranged on the end of the hub and stiffening ribs arranged on one side of the disk.

Another embodiment of the band wheel, shown in FIG. 6 consists of a disk 26 arranged on one end of the hub 25 and of stiffening ribs 27 adjoining the disk on only one side thereof.

Still another embodiment of the band wheel of this invention is shown in front view in FIG. 7 and in axial cross-sectional view in FIG. 8 and represents a single-piece injection or compression molding which imparts its rigidity by a honeycomb structure. The honeycombs open alternately towards one side of the wheel and towards the other, being uniformly distributed over both sides of the wheel. These honeycombs are formed by flat elements extending on the one hand transversely to the axis of rotation and on the other hand parallel to it. Extending from a hub 30 there are provided flat sections 31 and 32 having the shape of circular ring sectors which extend transverse to the axis of rotation, these sections extending 360° over the circumference of the wheel alternately in one of the two front sides of the wheel and in the other and from the edges of each of these sections 31 and 32 there extend rib-like sections 33 and 34 extending substantially parallel to the axis of rotation, the sections 33 extending on radii while the sections 34 are sector-shaped pieces. Of the sections so arranged in a plurality of concentric circles, the sections 31 and 32 have the shape of circular ring sectors which lie on the same front side of the wheel are arranged at an angle from each other so that the honeycomb structure of this band wheel is produced with the honeycombs open towards one side and the other side of the wheel constantly alternately both in circumferential direction and in radial direction from the inside to the outside (see FIG. 8.)

All the aforementioned embodiments of the band wheel have the advantages over the previously known band wheel in that they are low in weight and have a favorable manufacturing cost. In addition, there is a further advantage in that no undesired deformations of the wheel body occur during operation, as was true of the previously known cast spoked wheels, since the spokes of traditional band wheels bend as a result of the considerable accelerations upon reversal to which the band wheel is exposed in operation and can thereby change the position of the gripper head at the end of the band, referred to a given position of rotation of the band wheel, in operation by an excessive amount. This circumstance had a detrimental effect on the precise turning over of the thread to the second gripper head at the end of the flexible band of the opposite band wheel operating from the opposite side of the loom. On the other hand with the band wheel of this invention the gripper head which is arranged at the end of the band is always in the same position with the same position of rotation of the band wheel, even after a long period of operation so that no problems occur with respect to the transfer of the thread to the second gripper head.

It will be appreciated that various changes and modifications may be made within the skill of the art without departing from the spirit and scope of the invention illustrated and described herein.

What is claimed is:

1. Band wheel of light weight construction for a shuttleless loom operatively carrying a flexible band for the insertion of a filling thread during the oscillating movement of said band wheel produced by the alternate rotations of the band wheel; said band wheel having a hub adapted to rotate about an axis of rotation of said wheel and a wheel body connected with the hub; said wheel body comprising at least a circular disk fixed on said hub to rotate about the axis of rotation and formed by a flat element extending transverse to the axis of rotation, and reinforcing elements attached to the disk and formed by flat elements extending parallel to the axis of rotation.

2. Band wheel according to claim 1 in which the band wheel is formed from a lightweight rigid material.

3. Band wheel according to claim 2 in which the rigid material is metal.

4. Band wheel according to claim 2 in which the rigid material is plastic.

5. Band wheel according to claim 1 in which the spacer elements consist of radial stiffening ribs.

6. Band wheel according to claim 1 in which cooling vanes are arranged on the outside of the two circular disks.

7. Band wheel according to claim 1 in which said wheel comprises a disk arranged centrally on said hub adapted to rotate about an axis of rotation, and radially extending stiffening ribs adjoining the disk provided on both sides of said disk.

8. Band wheel according to claim 1 in which said wheel body comprises a disk arranged on one end of said hub, and radially extending stiffening ribs adjoining said disk on one side thereof.

9. Band wheel according to claim 5 in which the hub, the wheel body, and the stiffening ribs are connected together by pressing to form a unitary structure.

10. Band wheel according to claim 5 in which the hub, the wheel body, and the stiffening ribs are connected together by bonding to form a unitary structure.

11. Band wheel according to claim 1 in which each disk defines openings therein distributed over the surface thereof which together constitute up to two-thirds of the surface of the disk.

12. Band wheel according to claim 1 in which the space between the disks is filled with rigid plastic foam.

13. Band wheel according to claim 8 in which the space between the disks is filled with rigid plastic foam.

14. Band wheel according to claim 1 in which two circular disks in parallel relationship to each other are arranged on the hub and stiffening ribs consisting of rectangular plates are inserted in slots in the hub and fastened to the adjacent sides of said disks.

* * * * *